US006877945B2

(12) United States Patent
Ando et al.

(10) Patent No.: US 6,877,945 B2
(45) Date of Patent: Apr. 12, 2005

(54) FORKLIFT

(75) Inventors: Hideki Ando, Shiga (JP); Toshio Wada, Shiga (JP); Kazuhiro Fujikawa, Shiga (JP); Tomohiro Moriyama, Shiga (JP)

(73) Assignee: Nippon Yusoki Co., Ltd., Kyoto (JP)

( * ) Notice: Subject to any disclaimer, the term of this patent is extended or adjusted under 35 U.S.C. 154(b) by 217 days.

(21) Appl. No.: 10/152,676

(22) Filed: May 23, 2002

(65) Prior Publication Data

US 2002/0176771 A1 Nov. 28, 2002

(30) Foreign Application Priority Data

May 25, 2001 (JP) ..... P. 2001-156220

(51) Int. Cl.[7] ..... B65G 1/00
(52) U.S. Cl. ..... 414/631; 414/659; 414/662
(58) Field of Search ..... 414/631, 630, 414/659, 661, 662, 663, 664, 673, 718; 296/186.3, 186.4

(56) References Cited

U.S. PATENT DOCUMENTS 3,202,232 A * 8/1965 Rogers ..... 180/119
3,521,780 A * 7/1970 Cook ..... 414/632
4,411,582 A * 10/1983 Nakada ..... 414/636
4,998,858 A * 3/1991 Magens ..... 414/495
6,064,629 A * 5/2000 Stringer et al. ..... 367/128
6,168,367 B1 * 1/2001 Robinson ..... 414/539
6,269,913 B1 * 8/2001 Kollmannsberger et al. ..... 187/394

FOREIGN PATENT DOCUMENTS

| | | | |
|---|---|---|---|
| DE | 200 18 547 | U1 | 3/2001 |
| DE | 199 58 086 | A1 | 6/2001 |
| EP | 0 116 152 | A | 8/1984 |
| GB | 766292 | A | 1/1957 |
| GB | 2 118 521 | A | 11/1983 |
| JP | 8-143291 | A | 6/1996 |

OTHER PUBLICATIONS

Patent Abstracts of Japan: vol. 2002, No. 03, Apr. 3, 2002 JP 2001–322479 A: Nov. 20, 2001.

* cited by examiner

*Primary Examiner*—M. Scott Lowe
(74) *Attorney, Agent, or Firm*—Sughrue Mion, PLLC

(57) ABSTRACT

A forklift has a travelling carriage, a straddle arm disposed on the travelling carriage, a mast disposed on the straddle arm to be reciprocally movable in a horizontal direction, a fork disposed on the mast to be movable up and down, and a cover disposed on the travelling carriage. When the mast is in a reach-in operation, the cover covers at least an upper side of an article supported by the fork.

15 Claims, 14 Drawing Sheets

FORKLIFT

The present disclosure relates to the subject matter contained in Japanese Patent Application No. 2001-156220 filed May 25, 2001, which is incorporated herein by reference its entirety.

BACKGROUND OF THE INVENTION

1. Field of the Invention

The present invention relates to a forklift which takes an article therein, transports the article to a predetermined position, and carries the article in the predetermined position.

2. Description of the Related Art

A forklift of this kind is configured so as to have a mast disposed on a travelling carriage in a horizontally reciprocally movable manner, and a fork liftably disposed on the mast. In the forklift, the mast is moved toward an end of the travelling carriage to cause the forks to be projected from the travelling carriage (this motion of the mast is called "reach-out"), whereby the forks are inserted below an article which is to be accommodated. Thereafter, the forks are lifted by the mast to raise the article, and the mast is then moved inside the travelling carriage (this motion of the mast is called "reach-in"), whereby the article is accommodated on the travelling carriage. After the travelling carriage travels to a predetermined position, the mast performs a reach-out process to push out the forks together with the article to the outside of the travelling carriage. The forks are then lowered to place the article in the predetermined position.

In such a forklift according to the related art, a surface of the article in the accommodated condition is exposed, and hence there arises a problem in that the article is inevitable to contact with a foreign material. In a forklift used outdoors, particularly, an article is wet in case of rain or the like.

The invention has been conducted in view of the problem of the conventional art. It is an object of the invention to provide a forklift which can transport an accommodated article while preventing the article from contacting a foreign material.

SUMMARY OF THE INVENTION

In order to attain the object, according to a first aspect of the invention, there is provided a forklift having:

a travelling carriage;

a straddle arm disposed on the travelling carriage;

a mast disposed on the straddle arm to be reciprocally movable in a horizontal direction;

a fork disposed on the mast to be movable up and down; and a cover disposed on the travelling carriage, wherein when the mast is in a reach-in operation, the cover covers at least an upper side of an article supported by the fork.

According to a second aspect of the invention, there is provided the forklift according to the first aspect, in which the cover has a height to allow the mast to pass through the cover when the mast is in the reach-in operation.

According to a third aspect of the invention, there is provided the forklift according to any one of the first and second aspects, in which the cover has a length in the horizontal direction so that when the mast is in a maximum reach-out state, the fork is positioned outside the cover.

According to a fourth aspect of the invention, there is provided the forklift according to any one of the first and second aspects, wherein the mast has:

an outer mast moving along the straddle arm; and an inner mast lifting and lowering along the outer mast, and wherein the cover has a length in the horizontal direction so that when the mast is in a maximum reach-out state, the inner mast is positioned outside the cover.

According to a fifth aspect of the invention, there is provided the forklift according to any one of the third and fourth aspects, further having a position sensor for detecting a position of the mast in the horizontal direction, wherein when it is detected on the basis of a detection signal from the position sensor that at least one of the mast and the fork is positioned inside the cover, the fork is inhibited from being lifted and lowered outside a predetermined range.

According to a sixth aspect of the invention, there is provided the forklift according to any one of the third to fifth aspects, further having a position sensor for detecting a lifted position of the fork, wherein when it is detected on the basis of a detection signal from the position sensor that the lifted position of the fork is higher than a predetermined level, the mast is inhibited from performing the reach-in operation.

According to a seventh aspect of the invention, there is provided the forklift according to any one of the first to sixth aspects, further having a shutter, wherein the cover is fixed to the straddle arm;

wherein the cover is formed into a box-like shape to cover the upper, front, rear, right, and left sides of the article, wherein the cover defines an opening portion through which the article is taken in/out; and wherein the shutter closes/opens the opening portion.

According to a eighth aspect of the invention, there is provided the forklift according to the seventh aspect, wherein when the shutter opens the opening portion, the shutter is accommodated in the cover.

According to a ninth aspect of the invention, there is provided the forklift according to any one of the seventh and eighth aspects, wherein a window for interior inspection is defined at a side face of the cover.

According to a tenth aspect of the invention, there is provided the forklift according to any one of the seventh to ninth aspects, further having a door through which an operator enters and exits at a side face of the cover.

According to an eleventh aspect of the invention, there is provided the forklift according to any one of the seventh to tenth aspects, further having an article sensor for detecting a height and width of an article on the fork to detect whether or not the article is accommodatable, the article sensor disposed at the opening portion of the cover, wherein when the article sensor detects that the article is not accommodatable, the mast is inhibited from performing the reach-in operation.

According to a twelfth aspect of the invention, there is provided the forklift according to any one of the seventh to eleventh aspects, further having an end sensor for detecting a rear end of an article to be accommodated in the horizontal direction inside the opening, wherein when the end sensor detects the rear end of the accommodated article, the shutter is inhibited from closing.

According to a thirteenth aspect of the invention, there is provided the forklift according to any one of the fifth, sixth, eleventh, twelfth aspects, wherein when the inhibiting operation is conducted, an alarm is given.

According to a fourteenth aspect of the invention, there is provided the forklift according to any one of the fifth, sixth, eleventh and twelfth aspects, wherein notification of cancellation of the inhibiting operation is given.

According to a fifteenth aspect of the invention, there is provided the forklift according to any one of the first to fourteenth aspects, further having a restraining member for restraining an unnecessary motion of the accommodated article in the cover.

According to a sixteenth aspect of the invention, there is provided the forklift according to the fifteenth aspect, wherein the restraining member is positioned above the most-lowered position of the fork and on both sides of a lifting region of the fork; and wherein the restraining member has an article support surface which supports the article supported on the fork from a lower side of the fork, when the fork lowers.

BRIEF DESCRIPTION OF THE DRAWINGS

Exemplary embodiments are described below based on the drawings, in which like numerals represent like parts, and wherein.

DETAILED DESCRIPTION OF THE PREFERRED EMBODIMENTS

Hereinafter, an embodiment of the invention will be described with reference to the accompanying drawings.

Figure 1:
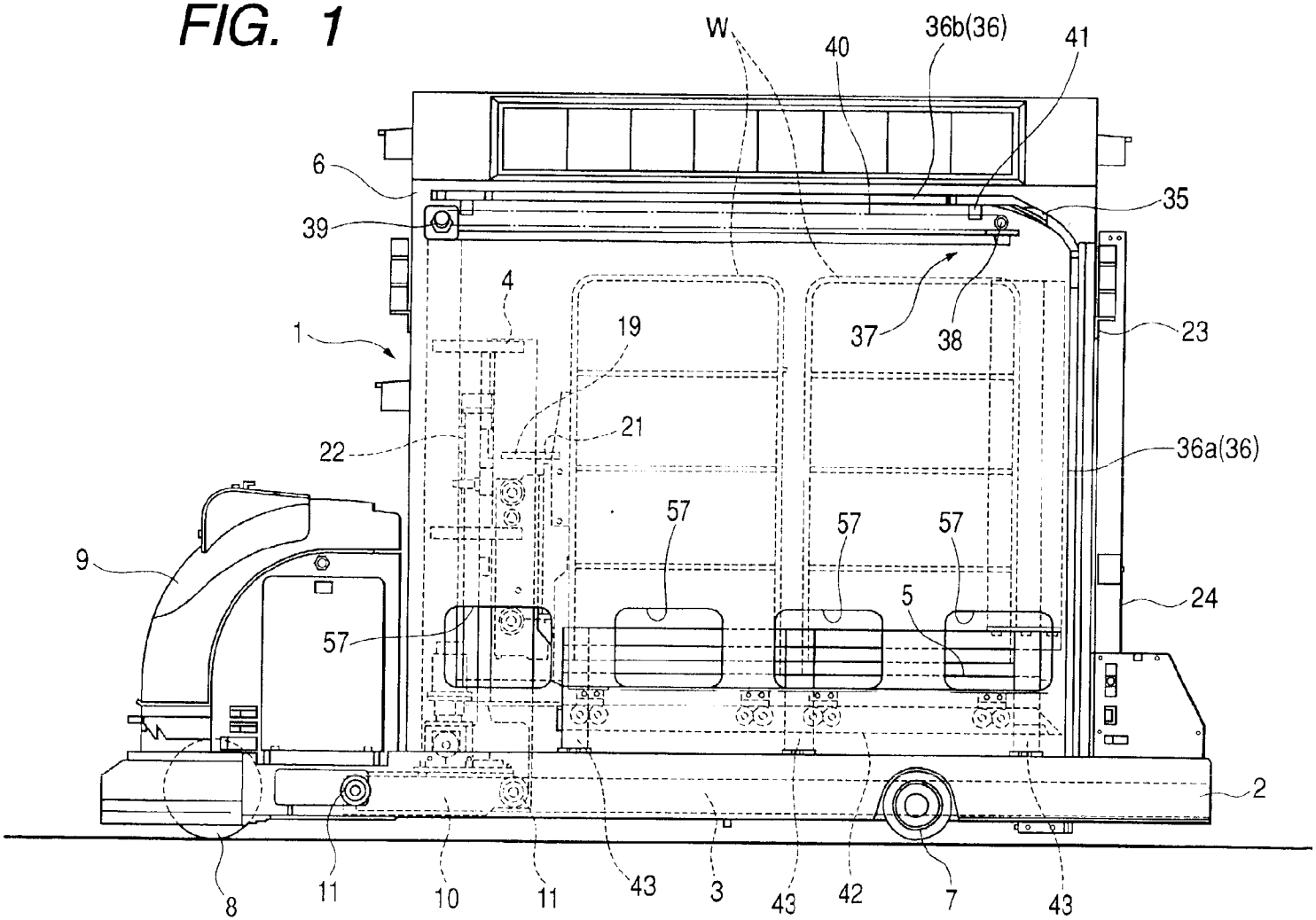
FIG. 1 is a side view showing an embodiment of the invention.
Figure 2:
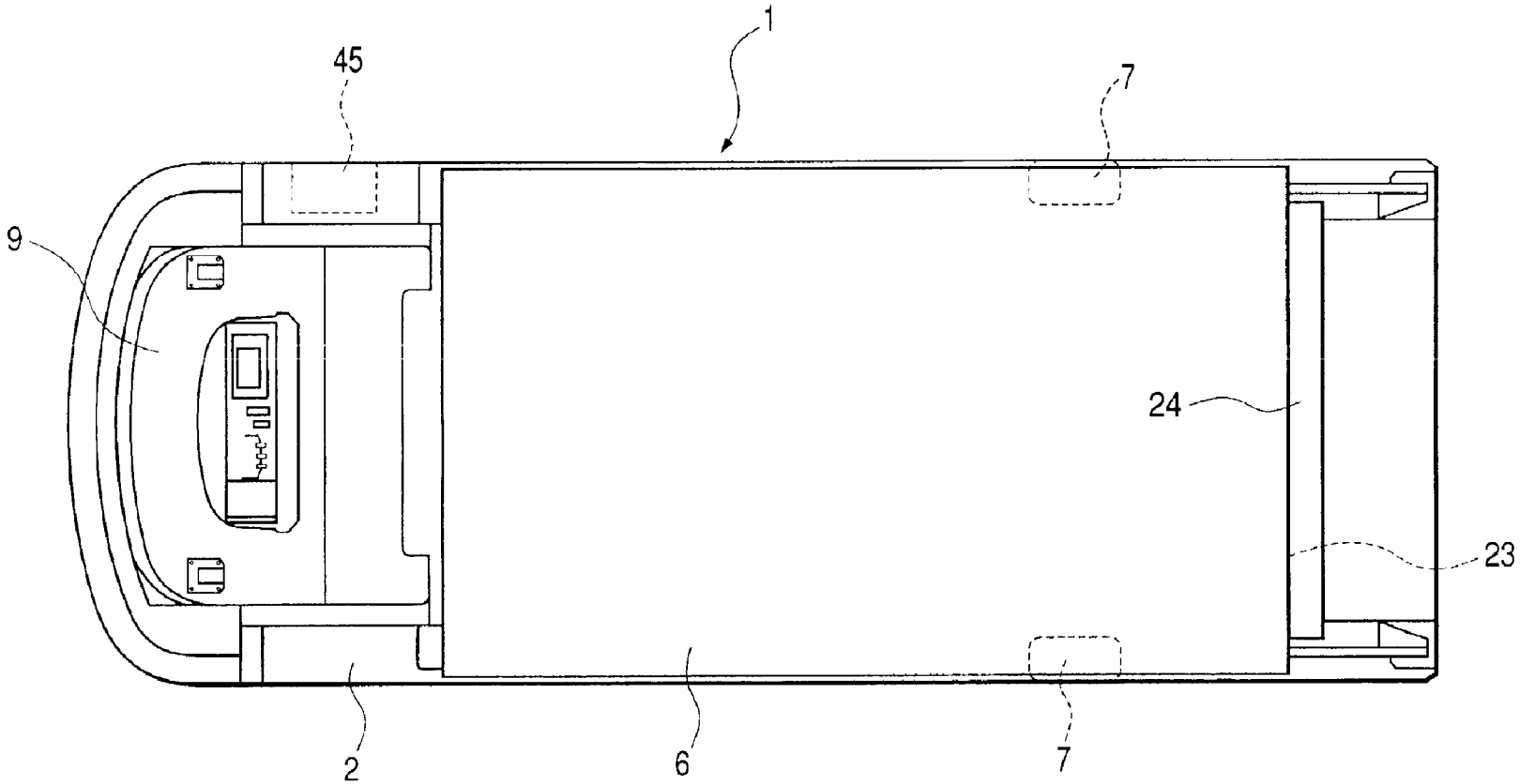
FIG. 2 is a plan view showing the embodiment of the invention.

In FIGS. 1 and 2, a reference numeral 1 denotes a forklift of the embodiment. In the embodiment, the forklift is an unmanned forklift, which travels outdoors to transport an article W.

A forklift has a basic configuration including a travelling carriage 2, a straddle arm 3 disposed on the travelling carriage 2 along a horizontal direction, a mast 4 disposed on the straddle arm 3 to be reciprocally movable in the horizontal direction, a fork 5 disposed on the mast 4 to be movable up and down, and a cover 6 disposed on the travelling carriage 2. When the mast 4 is in a reach-in operation (the reach-in operation is an operation in which the mast 4 moves toward the inside of the traveling carriage 2), the cover 6 covers at least an upper side of an article W, which is an article supported by the fork 5.

The configuration will be described in detail. Running wheels 7 are disposed below a front side (the right side in FIG. 1 where the article W is taken in/out) of the travelling carriage 2, and a steering wheel 8 which controls the traveling direction, and which serves also as a driving wheel is disposed below the rear side.

A control device 9 is disposed above the rear side of the travelling carriage 2. The control device has functions of driving and steering the steering wheel 8, and controls the functions and driving of the mast 4 and the forks 5. A secondary battery (not shown) which serves as a driving electric power source is disposed in the control device 9.

Figure 4:
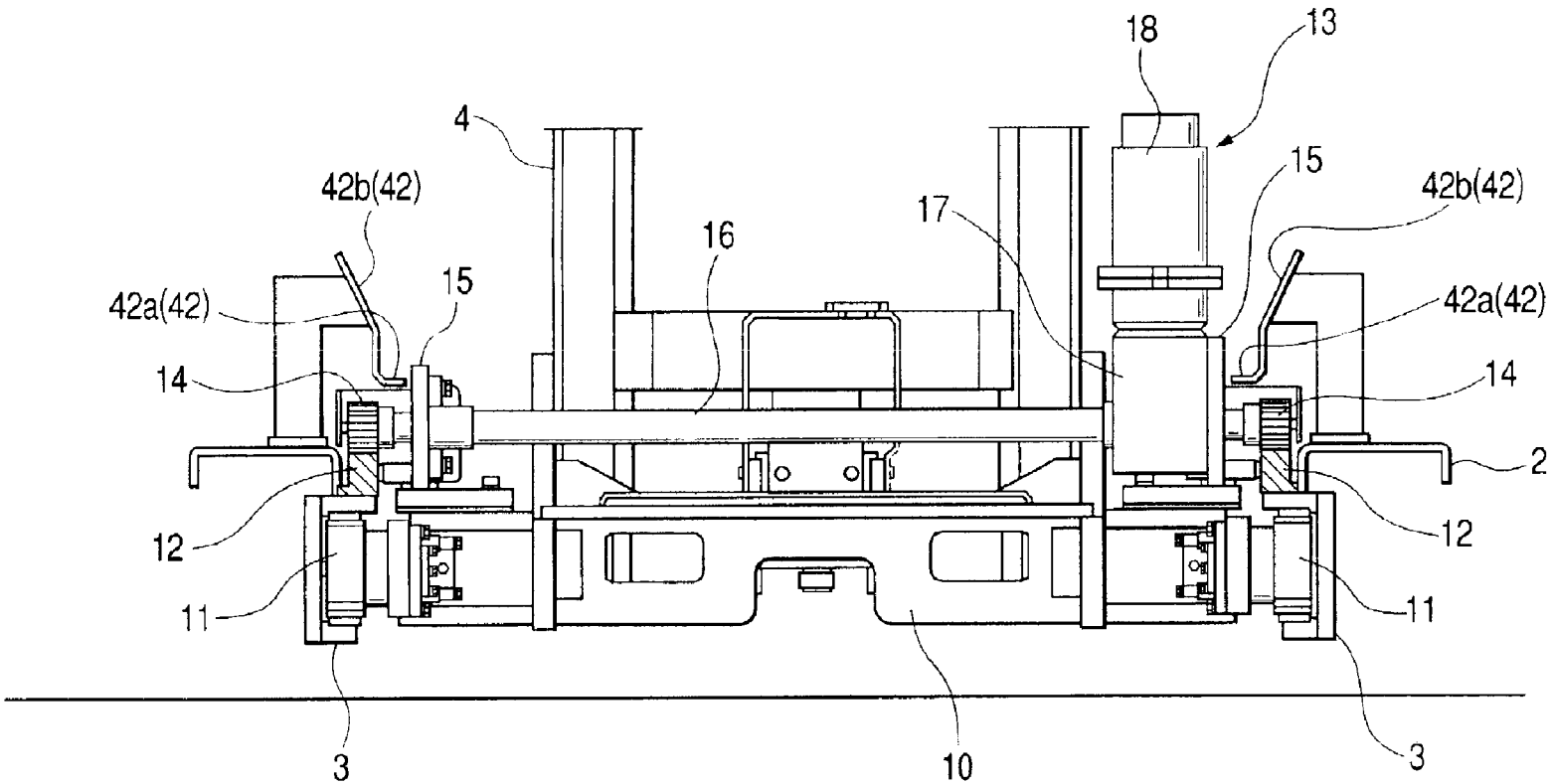
FIG. 4 is an enlarged longitudinal section view showing a base driving mechanism in the embodiment of the invention.

As shown in FIG. 4, the straddle arms 3 are formed to have a U-like section shape, and attached to the travelling carriage 2 so that their openings are opposed to each other.

A slide base 10 onto which the mast 4 is attached is movably mounted between the straddle arms 3. In the slide base 10, as shown in FIG. 4, running rollers 11 which are rollably fitted into the straddle arms 3 are rotatably attached to the both sides. A pair of the running rollers 11 are disposed in each of the straddle arms 3 with being separated from each other in the length direction of the straddle arms.

Racks 12 are attached integrally to the upper sides of the straddle arms 3 over a substantially whole length of the straddle arms, respectively. A base driving mechanism 13 which moves the slide base 10 is engaged with the racks 12.

As shown in FIG. 4, the base driving mechanism 13 is configured by: a pair of pinions 14 which mesh with the racks 12; a driving shaft 16 in which the pinions 14 are attached coaxially integrally to the both ends, respectively, and which is rotatably supported on the slide base 10 by a pair of brackets 15; a gear box 17 which is disposed in an intermediate portion in the length direction of the driving shaft 16; and a motor 18 which is mounted on the gear box 17 to rotate the driving shaft 16 in the forward and reverse directions via the gear box 17.

Figure 5:
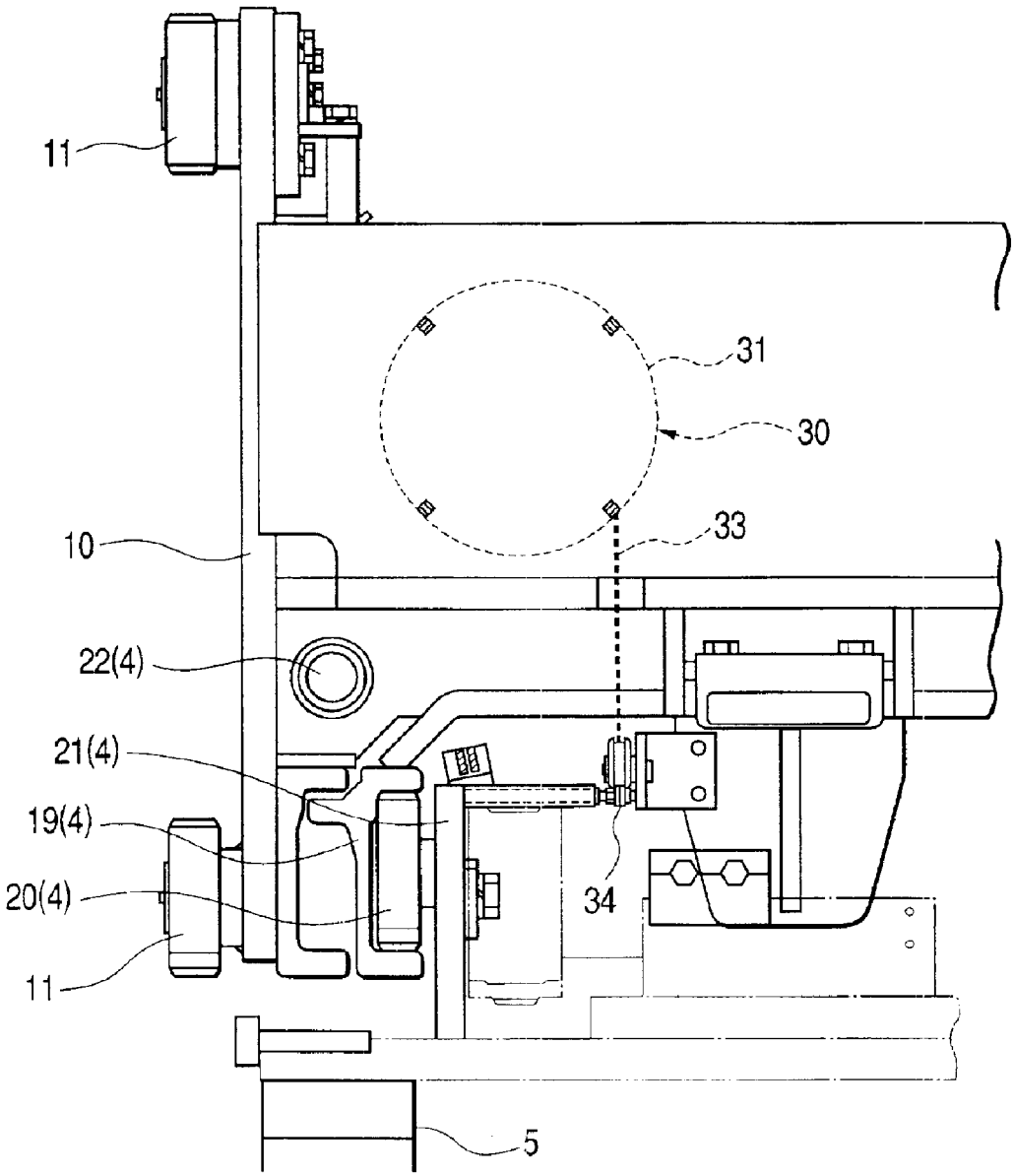
FIG. 5 is an enlarged plan view showing a position sensor of a mast in the embodiment of the invention.

In the embodiment, as shown in FIG. 5, the mast 4 is configured by: a pair of outer masts 19 which upstand integrally from the slide base 10 with being separated from each other in the width direction of the slide base 10; a pair of inner masts 21 which are liftably mounted on the insides of the outer masts 19 via guide rollers 20; and a cylinder 22 which upstands from the slide base 10, and which is coupled to the inner masts 21 via pulling cables such as chains. The forks 5 are attached integrally to the inner masts 21. The inner masts 21 are lifted or lowered by the cylinder 22, so that the forks 5 attached to the inner masts 21 are lifted or lowered.

Figure 6:
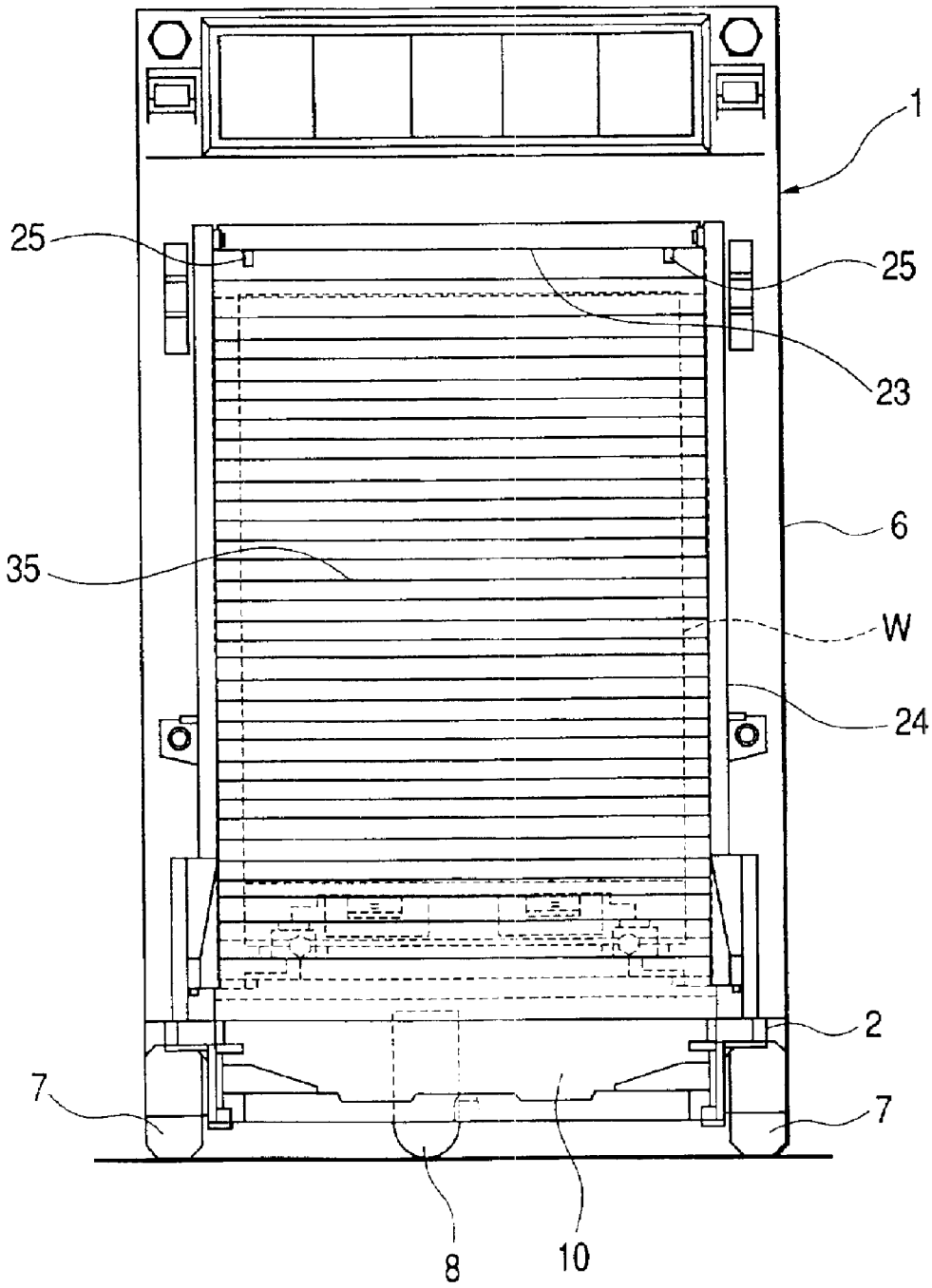
FIG. 6 is a front view showing the embodiment of the invention.

By contrast, as shown in FIGS. 1, 2, and 6, the cover 6 is formed into a box-like shape, and fixed integrally to upper portions of the straddle arms 3. An opening 23 is formed in the front face of the cover 6 so that, when the mast 4 is moved in the projection direction (this motion of the mast 4 is called reach-out), the forks 5, and the article W which is supported by the forks 5 are taken in/out through the opening 23.

As shown in FIG. 6, the opening 23 is formed so as to be higher than the height of the mast 4 in the reach-in process, or to be higher than the height of the article W which is supported by the forks 5 in the reach-in process, and to be wider than the width of the article W.

As shown in FIG. 6, a portal guard 24 is attached integrally to the front end face of the cover 6 so as to elongate along the side edge of the opening 23.

Article sensors 25 for detecting whether or not the height and width of the article W accommodated by the forks 5 exceed predetermined dimensions are disposed on the guard 24. For example, optical sensors are used as the article sensors 25. The optical sensors are placed inside the guard 24 and in the vicinity of the both sides of the upper end of the opening 23. The optical sensors emit a horizontal detection light beam corresponding to the limit height, and a pair of vertical detection light beams, which are separated from each other by a distance corresponding to the limit width. When one of these detection light beams is interrupted, it is judged that the article W exceeds the predetermined dimensions. When the optical sensors are of the reflection type, the above-mentioned judgment can be performed on the basis of existence of reflected light beams. A detection signal from the article sensors 25 is used for inhibiting the reach-in operation of the mast 4 when the shape of the article W is larger than an allowable shape.

Figure 3:
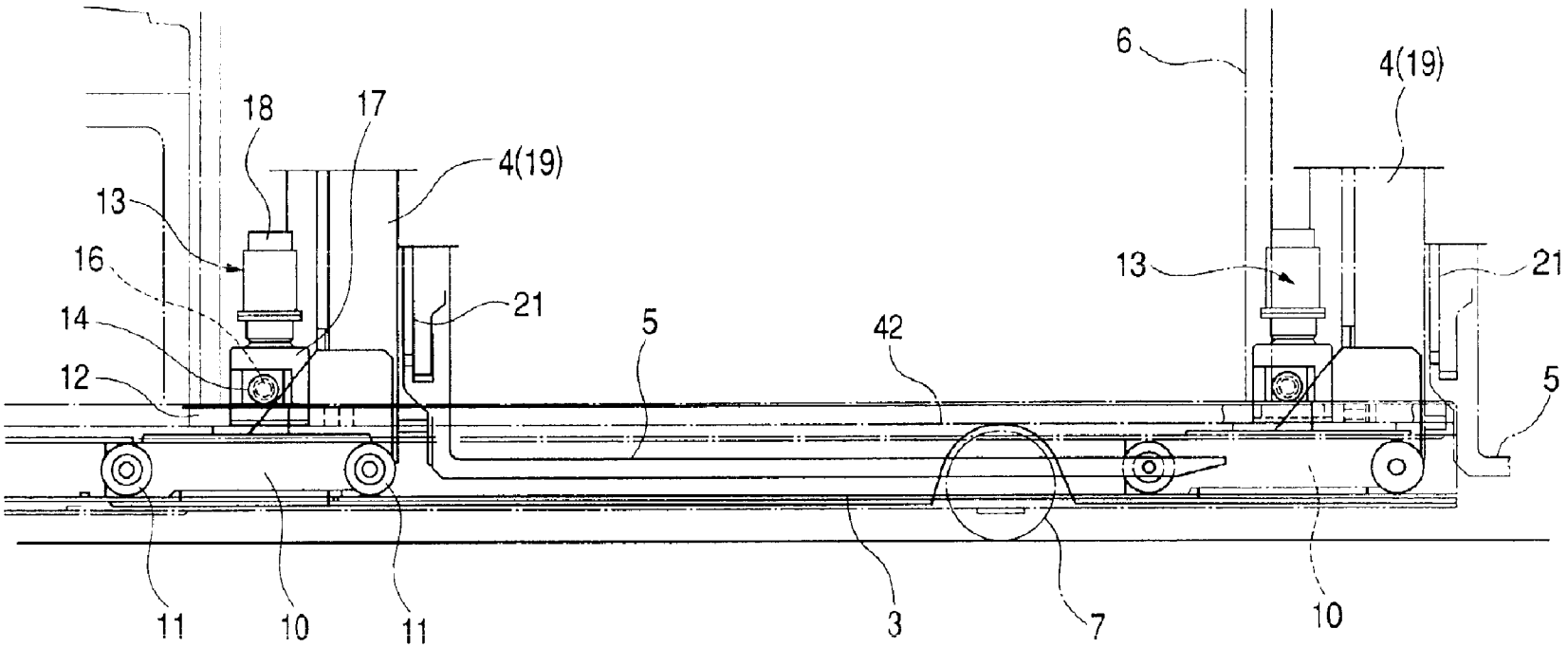
FIG. 3 is an enlarged side view showing main portions of the embodiment of the invention.

The length of the cover 6 in the movement direction of the mast 4 (i.e., the reach direction) is set so that when the mast 4 is in the maximum reach-out state, the inner masts 21 are positioned outside the cover as shown in FIG. 3.

Figure 7:
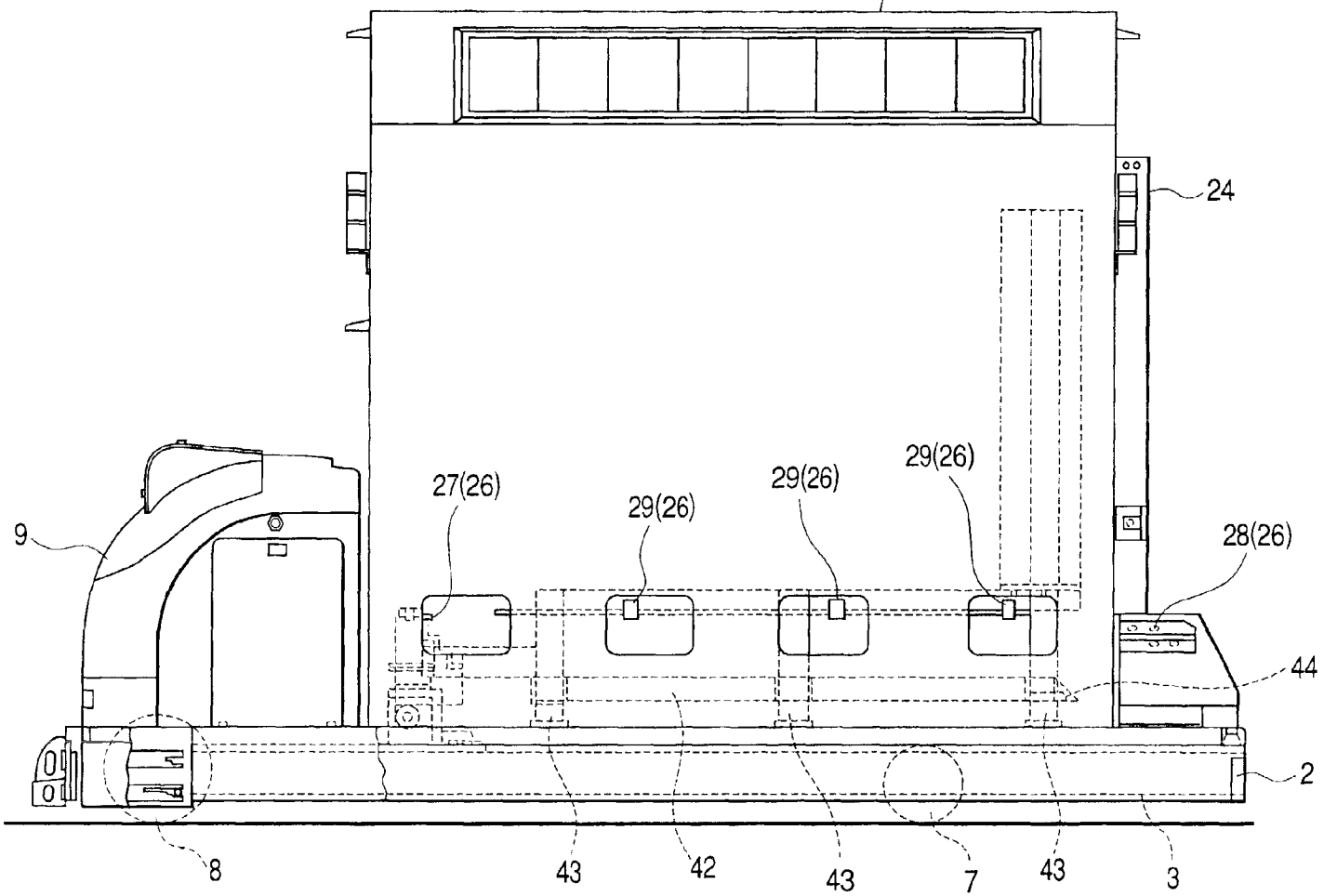
FIG. 7 is a partially omitted side view showing the embodiment of the invention.

In the embodiment, a position sensor 26 which detects the position of the mast 4 in the reach direction is disposed on the straddle arms 3. As shown in FIG. 7, the position sensor 26 includes a reach-in sensor 27, a reach-out sensor 28, and intermediate position sensors 29. The reach-in sensor 27 is disposed in the vicinity of the inner ends of the straddle arms 3 to detect the most reach-in position of the mast 4 (the most reach-in position is a position on the forklift, which the most far from the front side of the traveling carriage 2 and the mast 4 can move to). The reach-out sensor 28 is disposed in the vicinity of the front ends of the straddle arms 3 to detect the most reach-out position of the mast 4 (the most reach-out position is a position outside the cover 6, which the most far from the cover 6 and the mast 4 can move to). The plurality of intermediate position sensors 29 are disposed at predetermined intervals between the reach-in sensor 27 and the reach-out sensor 28.

The reach-in sensor 27 or the reach-out sensor 28 is formed so that, at the timing when the mast 4 reaches the vicinity of the most reach-in position or the most reach-out position, the movement speed of the mast 4 is reduced, and the mast is then stopped at the most reach-in position or the most reach-out position. In accordance with detection signals of the intermediate position sensors 29, the mast 4 is moved at a normal speed between the most reach-in position and the most reach-out position.

When the mast 4 is detected by the reach-in sensor 27 to detect that the forks 5 are positioned inside the cover, the forks 5 are inhibited from being lifted or lowered outside a predetermined range.

Figure 8:
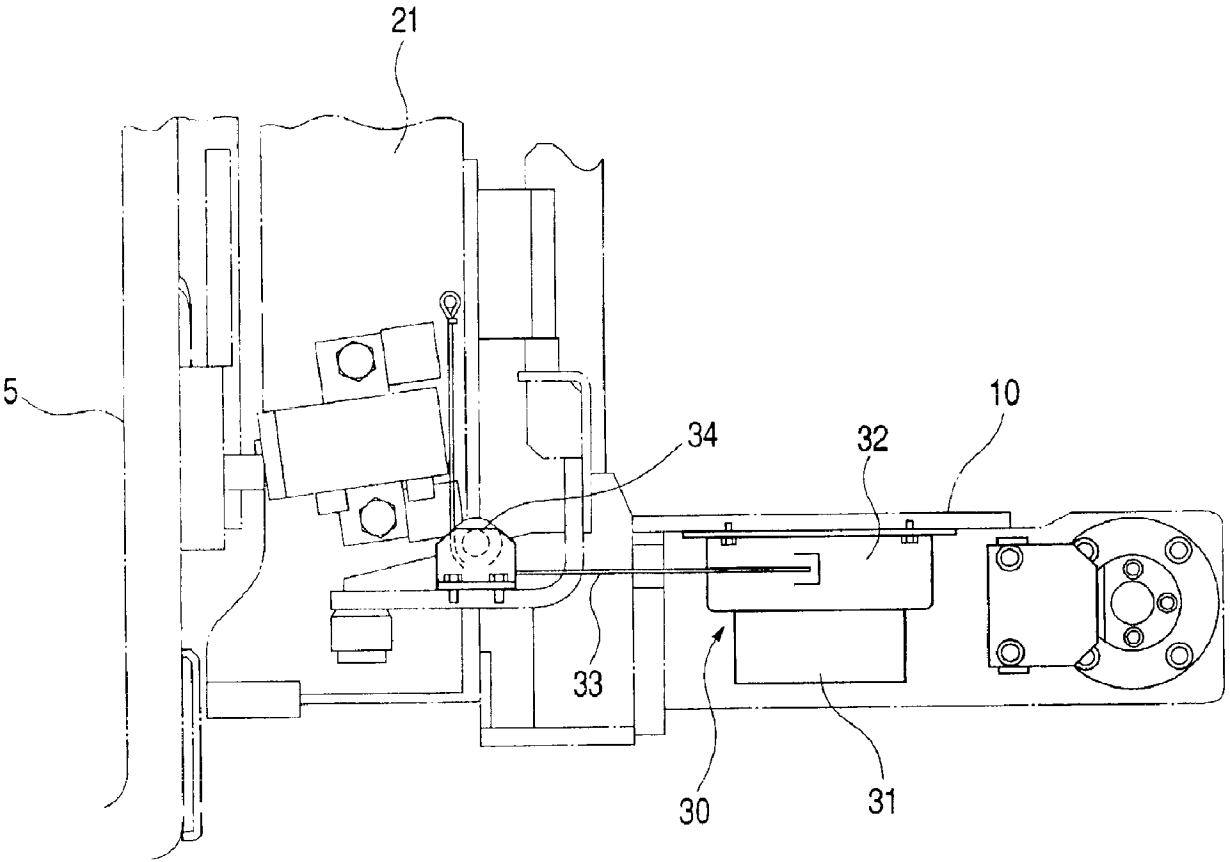
FIG. 8 is an enlarged side view showing main portions of the position sensor of the mast in the embodiment of the invention.

As shown in FIGS. 5 and 8, a position sensor 30 for detecting a lifted position of the forks 5 is disposed between the slide base 10 and the inner mast 21.

The position sensor 30 includes a reel 32 having a pulse counter 31, a wire 33 wound around the reel 32 and pulled out from the reel 32 to be fixed to the inner mast 21, and a pulley 34 attached to the slide base 10 to guide the wire 33.

The wire 33 is always pulled in the winding direction by a spring incorporated in the reel 32 to be held in a state of tension. The wire is pulled out from the reel 32 in accordance with lifting of the inner mast 21 and wound around the reel 32 in accordance with lowering of the inner mast 21.

The lifted distance of the inner mast 21 is equal to the pulled-out length of the wire 33. When the pulled-out length of the wire 33, i.e., the rotational amount of the reel 32 is detected by the pulse counter 31, the lifted distance of the inner mast 21 can be calculated.

When it is detected on the basis of a detection signal from the position sensor 30 that the lifted position of the forks 5 is higher than a predetermined level, the reach-in operation of the mast 4 is inhibited.

In the embodiment, a shutter 35 which closes and opens the opening 23 is disposed in the cover 6.

The shutter 35 is configured by sequentially connecting long sides of many rectangular plates by hinges in a swingable manner. The both short sides of the plates are slidably fitted into guide grooves 36 which are formed in the inner side face of the cover 6, so that the shutter is mounted on the cover 6.

As shown in FIG. 1, each of the guide grooves 36 is configured by a vertical portion 36*a* which elongates along the opening 23 and a horizontal portion 36*b* which elongates along the ceiling of the cover 6. A connecting portion between the vertical portion 36*a* and the horizontal portion 36*b* is arcuately formed to enable the shutter 35 to move between the vertical portion 36*a* and the horizontal portion 36*b*. When the shutter 35 is positioned in the vertical portion 36*a*, the opening 23 is closed, and when the shutter 35 is moved into the horizontal portion 36*b*, the shutter is accommodated in the cover 6 and the opening 23 is opened.

Figure 9:
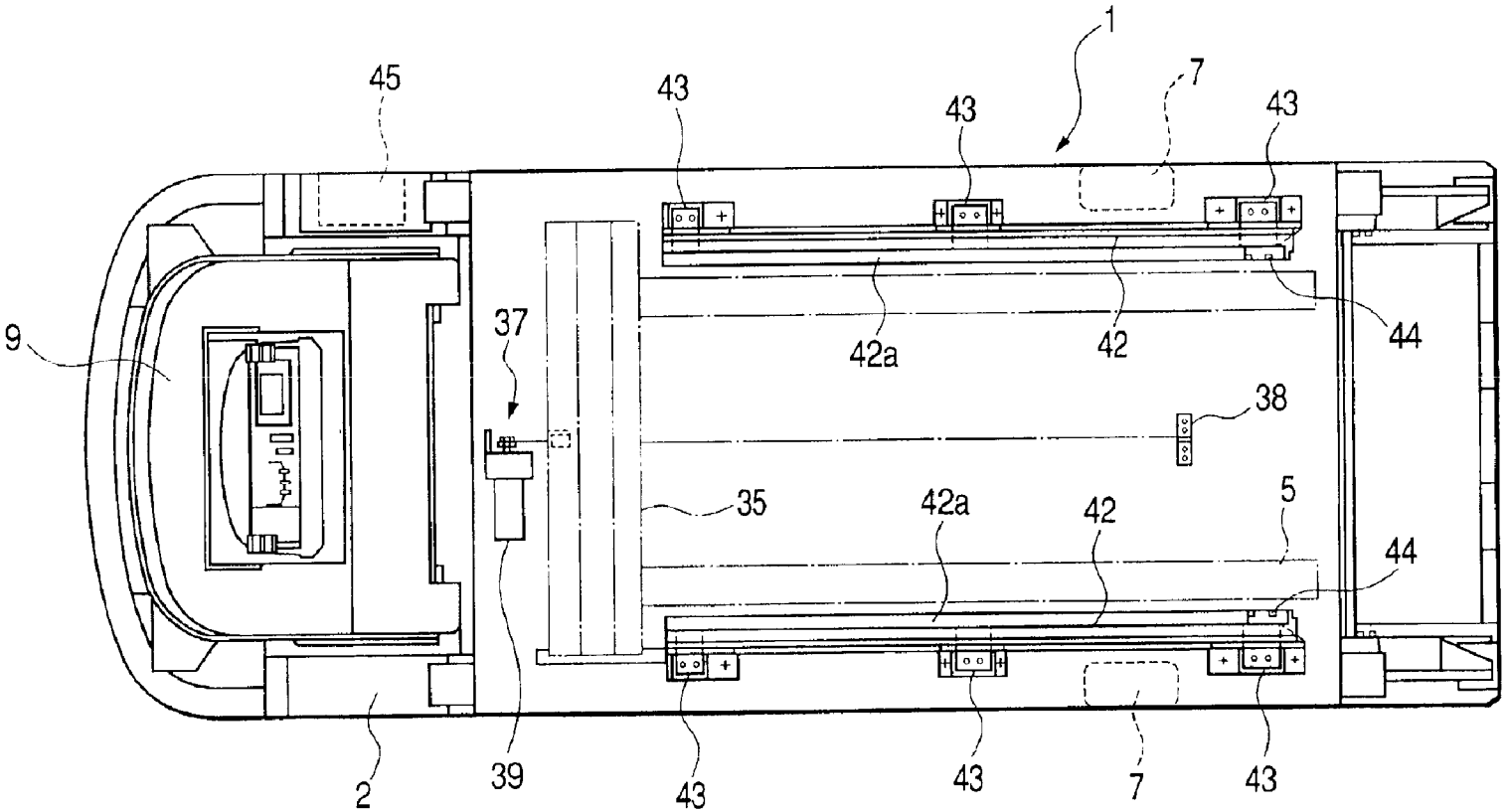
FIG. 9 is a partially omitted plan view showing the embodiment of the invention.

As shown in FIGS. 1 and 9, a driving mechanism 37 which moves the shutter 35 along the guide grooves 36 is disposed in the ceiling portion of the cover 6 and the position which is below the movement locus of the shutter 35.

The driving mechanism 37 is configured by: a sprocket 38 which is rotatably mounted in the vicinity of the opening 23; a geared motor 39 which is mounted with being separated from the sprocket 38 in the accommodating direction of the shutter 35; and an endless belt 40 such as a chain which is wound between the sprocket 38 and the geared motor 39. An upper end portion of the shutter 35 is coupled to an intermediate portion of the endless belt 40 via a coupling member 41.

Figure 10:
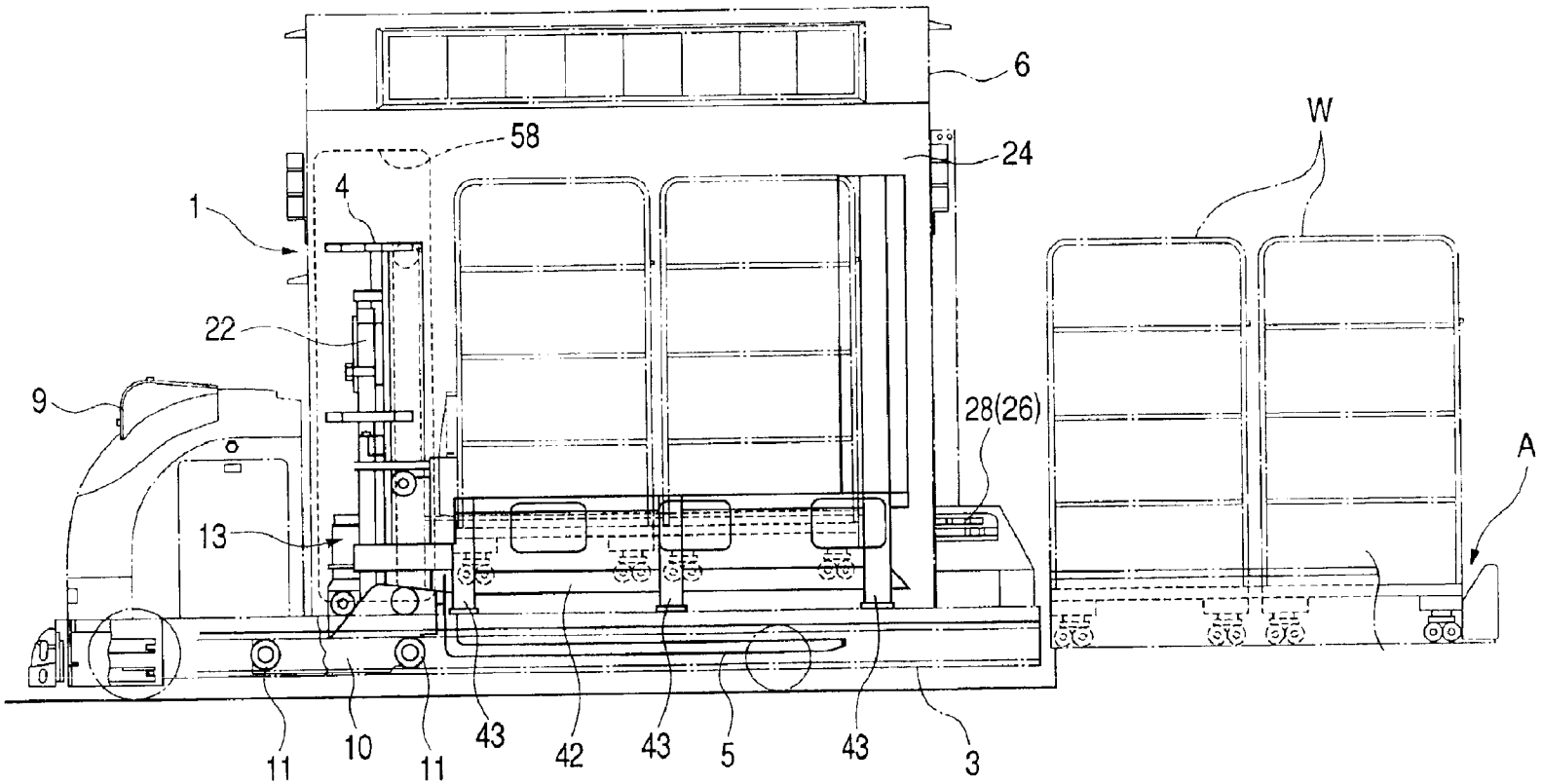
FIG. 10 is a partially omitted side view showing the embodiment of the invention.

As shown in FIGS. 9 and 10, restraining members 42 which restrain an unnecessary motion of the accommodated article W are mounted via a plurality of brackets 43 in portions which are above the straddle arms 3 and inside the cover 6.

The restraining members 42 are positioned above the most-lowered position of the forks 5 as shown in FIG. 10, and on the both sides of the lifting region of the forks 5 as shown in FIG. 9.

In each of the restraining members 42, as shown in FIGS. 4 and 9, an article support face 42*a* which supports the article W from the lower side is formed, and a side support face 42*b* is formed so as to upward extend from the side of the article support face 42*a* which is on the outer side of the forklift 1. The side support faces 42*b* are formed so that their upper portions are inclined toward the outer sides, thereby guiding the article W, which is to be placed on the restraining members 42, toward the article support faces 42*a*.

In the restraining members 42, stoppers 44 are disposed in end portions of the article support faces 42*a* on the side of the opening 23, respectively. The article W which is placed on the article support faces 42*a* is engaged with the stoppers 44, thereby restraining movement of the article W toward the opening 23.

On the other hand, in the embodiment, a connector 45 is disposed in a side portion of the control device 9 as shown in FIGS. 2 and 9. A charging arm for charging the secondary battery mounted in the control device is to be connected to the connector.

Figure 11:
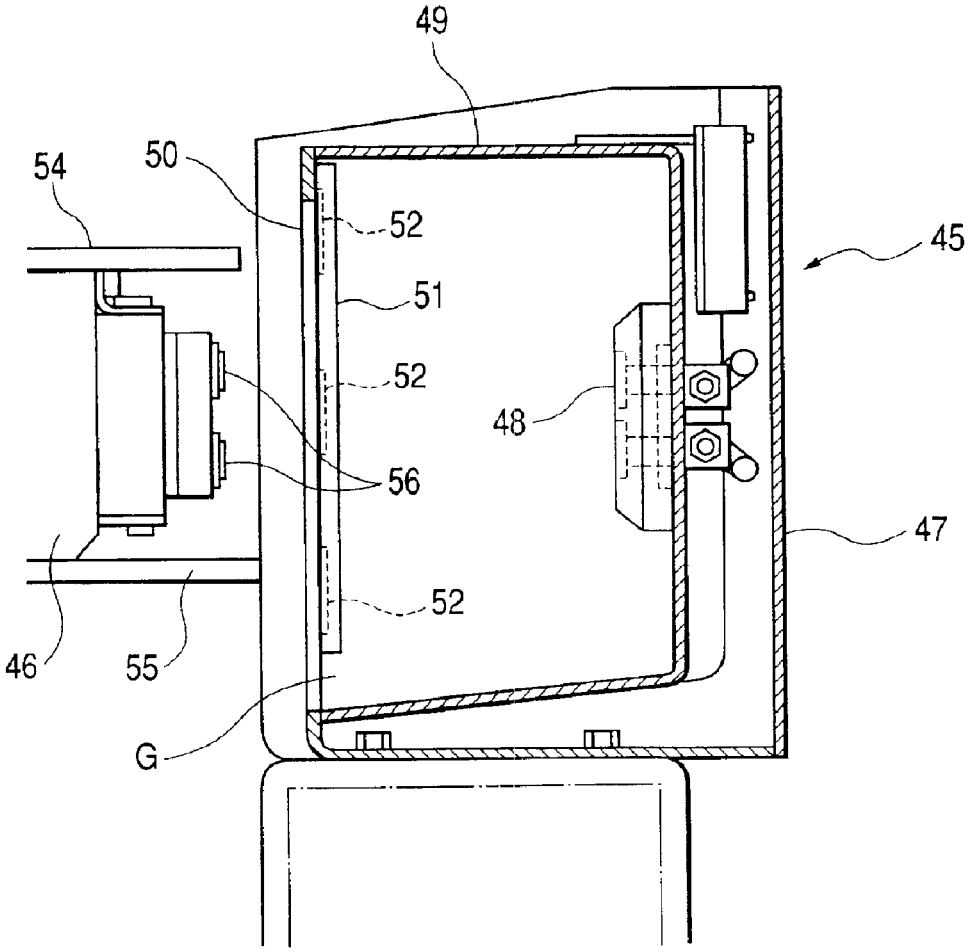
FIG. 11 is an enlarged longitudinal section view showing a charging connector in the embodiment of the invention.
Figure 12:
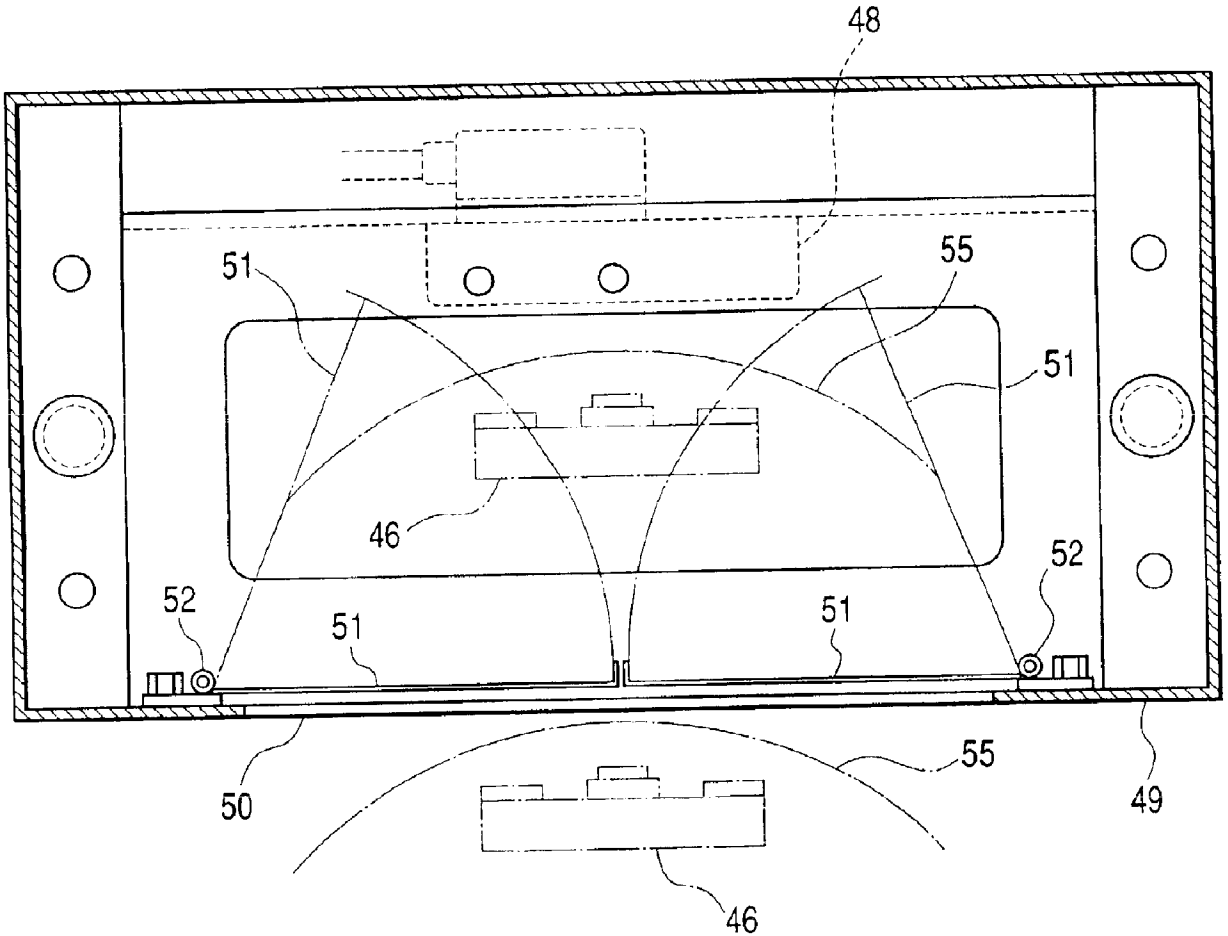
FIG. 12 is an enlarged cross section view showing the charging connector in the embodiment of the invention.

Specifically, as shown in FIG. 11, the charging arm 46 disposed in a charging terminal or the like is to be inserted into the connector 45 to be electrically connected thereto. The connector 45 is attached to the main section 47 of the control device 9, and comprises a charging shoe 48 to which the charging arm 46 is electrically connected, and a box-like cover 49 which covers the periphery of the charging shoe 48.

In the cover 49, an insertion port 50 for the charging arm 46 is disposed in a side portion, and a pair of doors 51 which close and open the insertion port 50 are swingably disposed inside the cover 49.

The doors 51 are openably supported on the inner face of the cover 49 by a plurality of hinges 52 which are disposed in the vicinity of the both sides of the insertion port 50, so as to be opened toward the inner sides of the cover 49 in a bipartite manner. Springs which urge the doors 51 in a closing direction are incorporated in the hinges 52, so that the doors 51 are normally held by the springs to the respective closing positions.

As shown in FIG. 11, the bottom face of the cover 49 is inclined so that the inner side is higher in level, and the lower end of the bottom face is continuous to the lower end edge of the insertion port 50. A gap G of a predetermined height is formed between the lower end of each of the doors 51 and the lower end edge of the insertion port 50, so that water drops or the like which enter inside the cover 49 are guided by the inclination of the bottom face of the cover 49 to the lower end edge of the insertion port 50 to be discharged to the outside through the gap G.

Figure 13:
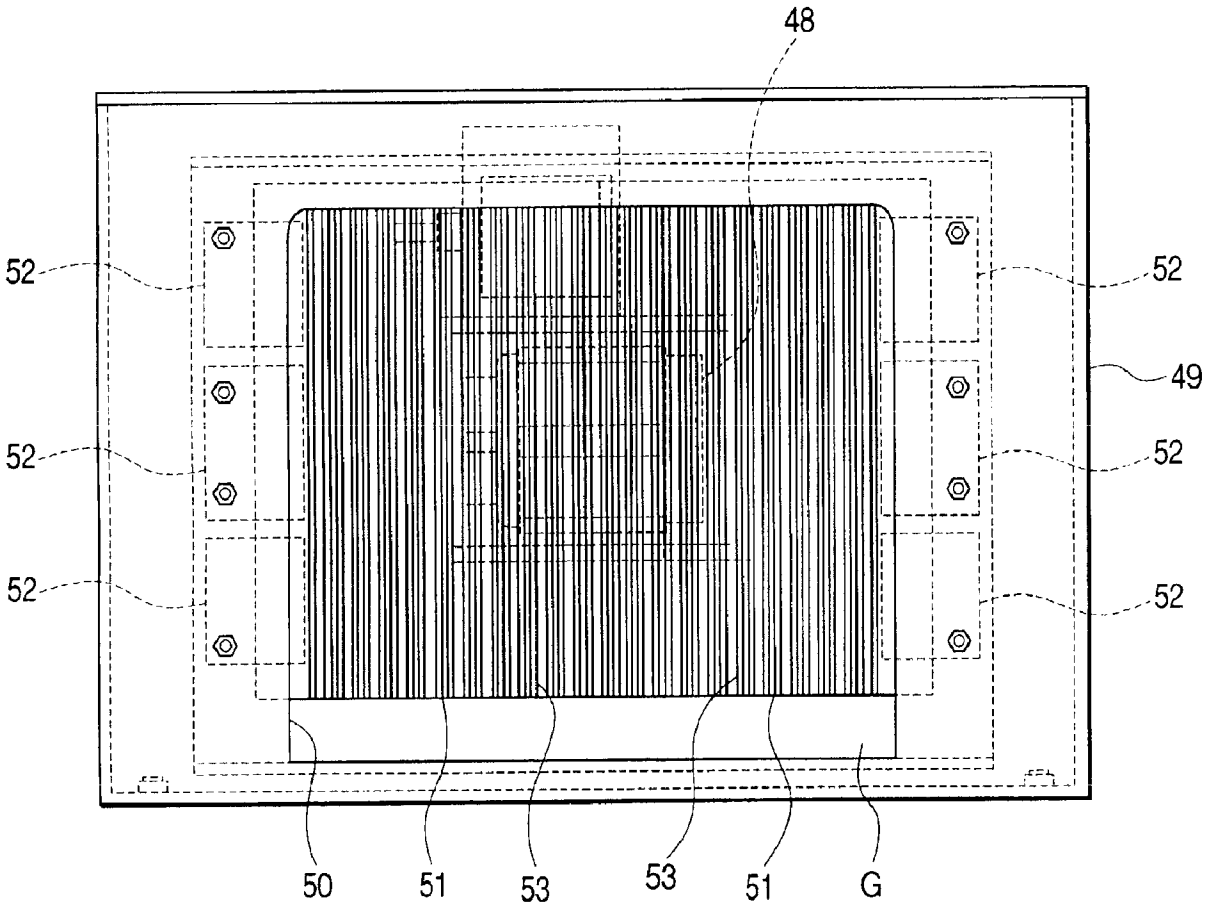
FIG. 13 is an enlarged side view showing the charging connector in the embodiment of the invention.
Figure 14:
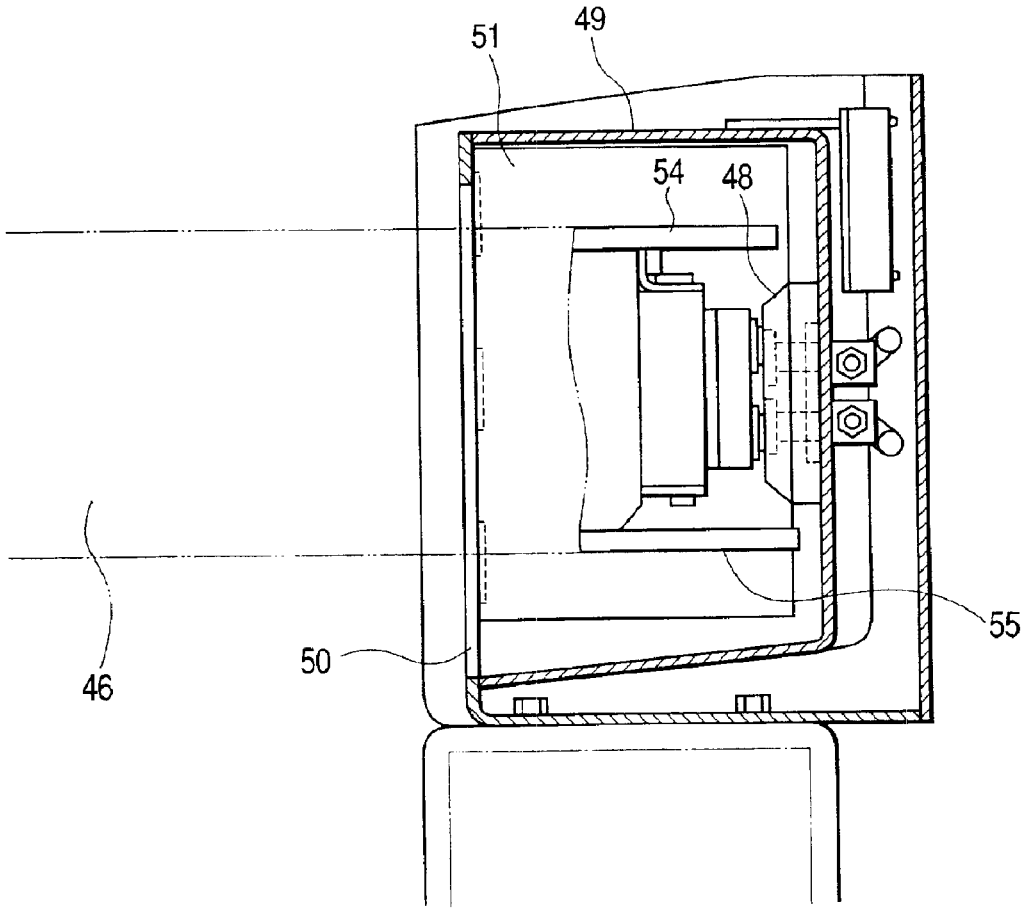
FIG. 14 is an enlarged longitudinal section view illustrating the function of the charging connector in the embodiment of the invention.

In the embodiment, as shown in FIG. 13, many vertical grooves 53 are formed in the outer faces of the doors 51. The vertical grooves 53 are disposed in order to, when water drops or the like adhere to the outer faces of the doors 51, quickly guide the water drops or the like to a lower side.

In the charging arm 46 shown in the embodiment, protection plates 54 and 55 which are projected to the front side are disposed above and below the end portion on the insertion side, respectively. The protection plates 54 and 55 are projected more than end faces of electrodes 56 disposed at the tip end of the charging arm 46. When the charging arm 46 is to be inserted into the cover 49, the protection plates are in contact with the doors 51 in advance of the electrodes 56, and push the doors 51 open, thereby preventing the electrodes 56 from contacting the doors 51.

The tip end portions of the protection plates 54 and 55 are formed into an arcuate shape in a plan view, so that the above-mentioned operation of pushing the doors 51 open can be smoothly conducted. The tip end of the protection plate 55 which is positioned in the lower side is more forward projected than that of the protection plate 54 which is positioned in the upper side.

This configuration is employed in order to, when the doors 51 to which water drops or the like adhere are to be opened, cause the doors to be first in contact with the lower protection plate 55, and catch the water drops or the like by a portion below the electrodes 56, thereby preventing the water drops or the like from dropping on the electrodes 56.

In FIG. 1, reference numeral 57 denotes windows for interior inspection, which are formed in a side face of the cover 6.

As shown in FIG. 10, the thus configured forklift 1 of the embodiment is moved to an article carrying-in station A to conduct an operation of loading the article W in the article carrying-in station A.

When the forklift is moved in this way to the article carrying-in station A, first, the shutter 35 is pulled up by the driving mechanism 37 toward the ceiling portion of the cover 6 to be accommodated therein, and the opening 23 of the cover 6 is largely opened. As a result, the forks 5 are stopped at a position opposed to a gap below the article W.

Then, the base driving mechanism 13 is actuated to start the reach-out operation. When the mast 4 is detected by the reach-out sensor 28, the reach-out operation is stopped. In the stopped state, the forks 5 are inserted below the article W which is positioned in the article carrying-in station A.

The inner masts 21 constituting the mast 4 are raised by the cylinder 22. In accordance with this raising, the article W is lifted by the forks 5. When the lifted distance of the article W becomes equal to a predetermined distance, the operation of raising the forks 5 is stopped. The stopping position of the forks 5 is controlled on the basis of the detection signal from the position sensor 30.

When the lifting of the article W is completed in this way, the base driving mechanism 13 is again actuated to start the reach-in operation, and the mast 4 and the forks 5 are moved toward the interior of the cover 6, thereby starting the operation of accommodating the article W. In the case where the lifted position of the forks 5 is higher than a predetermined height, even if the lifted article W has a size which allows the article to be accommodated, it is assumed that the upper end of the article is positioned in a level which is higher than the upper end of the opening 23. In this case, therefore, the reach-in operation is not conducted. In the case where the lifted position of the forks 5 is adequate, the reach-in operation is started. When the article W is then pulled into the guard 24 surrounding the opening 23, the height and width of the article W are measured by the article sensors 25 disposed on the guard 24. If it is judged that the size of the article W exceeds the predetermined shape, the reach-in operation of the forks 5 is stopped, and notification is made by an alarm or the like.

On the other hand, if it is judged that the size of the article W is not larger than the predetermined shape, the reach-in operation is continuously conducted. When the mast 4 is pulled into a predetermined position in the cover 6, the position of the mast 4 is detected by the intermediate position sensors 29, with the result that the movement speed of the slide base 10 is increased so that high-speed movement is conducted. At the timing when the mast reaches the vicinity of the most reach-in position, the mast is stopped at the most reach-in position while being decelerated on the basis of the detection signal from the reach-in sensor 27.

When a rear end portion of the accommodated article W in the accommodating direction is detected by, for example, the article sensors 25, it is judged that the article W is not completely accommodated in the cover 6. Then, notification is made by an alarm or the like, and the driving mechanism 37 is not actuated, so that the shutter 35 is held to the opened state. Alternatively, the detection of a rear end portion of the accommodated article W may be performed by separately disposing a rear-portion sensor inside the cover 6 and in the vicinity of the opening.

If it is judged that the article W is completely accommodated in the cover 6, the driving mechanism 37 is actuated to move the shutter 35 toward the opening 23 to close the opening 23.

In a state where the article W is completely accommodated in the cover 6 and the forks 5 are positioned in the cover 6, the lifting range of the forks 5 is limited. This process is conducted because of the following reason. When the forks 5 are lifted by a degree which is more than necessary, there is a possibility that an upper portion of the article W supported by the forks 5 may damage the driving mechanism 37 and the like which are disposed in an upper portion inside the cover 6. The process is conducted in order to prevent such a failure from occurring.

The forks 5 are lowered in the range which is limited as described above, thereby allowing the forks 5 to be lowered with passing between the pair of the restraining members 42 which are placed in the lower portion of the cover 6. In the middle of the lowering process, the article W supported by the forks 5 is supported by the article support faces 42*a* of the restraining members 42 to stop the lowering of the article. The operation of lowering the forks 5 is continued, and stopped at the timing when the forks are lowered below the restraining members 42.

The lifted position of the forks 5 is detected by the position sensor 30 which is disposed between the slide base 10 and one of the inner masts 21.

By contrast, when the article W is to be placed on the article support faces 42*a* of the restraining members 42, the article is guided toward the article support faces 42*a* by the inclined faces of the side support faces 42*b*, so that the article is placed smoothly and surely on the article support faces 42*a*. Since the stoppers 44 disposed on the article support faces 42*a* are opposed to the end portions on the side of the opening 23, the article W which is placed on the article support faces 42*a* is restrained from being accidentally moved toward the opening 23.

The forklift 1 which accommodates the article W as described above can transport the article W to a target position in a state where the article W is surrounded by the cover 6 and the shutter 35. The accommodated article W can be carried out by conducting the above-mentioned operations in the reverse sequence. Therefore, there is no possibility that, in the course of the transportation, the article W is in contact with a foreign material or gets wet by rain or the like.

In the embodiment, since the inspection windows 57 are disposed in the side face of the cover 6, the components in the cover 6 can be easily inspected.

In the embodiment described above, the shapes, dimensions, and the like of the components are exemplarily shown, and can be variously changed depending upon design requirements or the like. In the embodiment, for example, the cover 6 is formed into a box-like shape. Alternatively, the cover may be formed so as to cover only the upper side of the article W.

When any one of the above-mentioned various inhibiting operations is cancelled, the cancellation may be notified acoustically or visually by a sound device or a display device. As shown by reference numeral 58 in FIG. 10, a door through which the operator can enter and exit may be formed in a side face in the vicinity of the rear end of the cover 6.

As described above, in the forklift according to the first to fourth aspects of the invention, when the mast is in the reach-in operation, the cover covers at least an upper side of the article supported by the fork is disposed on the travelling carriage. Hence, a foreign matter, water drops, and the like are prevented from adhering to the accommodated article. Therefore, the soundness of the transported article can be ensured. When the fork is projected completely outside the cover, an article can be surely lifted and accommodated.

In the forklift according to the fifth aspect of the invention, when it is detected that the mast or the fork attached to the mast is positioned inside the cover, the fork is inhibited from being lifted or lowered outside a predetermined range. Therefore, the lifting and lowering of the fork by a degree which is more than necessary can be limited, so that the fork and the article are prevented from accidentally contacting another apparatus or the components.

In the forklift according to the sixth aspect of the invention, when it is detected that the lifted position of the fork is higher than a predetermined level, the mast is inhibited from performing the reach-in operation. Therefore, it is possible to prevent the article supported by the fork from contacting the cover, thereby preventing the article from being damaged.

In the forklift according to the seventh aspect of the invention, the cover is fixed to the straddle arm and formed into a box-like shape. The cover covers the upper, front, rear, right, and left sides of the article. An opening through which the article is to be taken in/out is formed in a reach-out direction of the mast. A shutter, which closes and opens the opening, is disposed. Therefore, an article can be taken in/out through the opening, and a substantially whole periphery of the accommodated article is covered, whereby the article can be completely protected from a foreign material, rain, and the like.

In the forklift according to the eighth aspect of the invention, when the opening is opened, the shutter is accommodated in the cover. Therefore, the shutter is prevented from being projected to the outside of the cover, whereby the forklift can be made compact.

In the forklift according to the ninth and tenth aspects of the invention, a window for interior inspection is formed in a side face of the cover. Therefore, interior inspection can be easily conducted.

In the forklift according to the eleventh aspect of the invention, an article sensor which detects a height and width of an article on the fork to detect whether or not the article is accommodatable is disposed in the opening of the cover. When the article sensor detects that the article is not accommodatable, the mast is inhibited from performing the reach-in operation. Therefore, an article, which is not accommodatable, is prevented from being damaged by carelessly conducting an operation of accommodating the article.

In the forklift according to the twelfth aspect of the invention, an end sensor for detecting a rear end portion of an article to be accommodated in an accommodating direction is disposed inside the opening. When the end sensor detects the rear end portion of the accommodated article, the shutter is inhibited from performing the closing operation. Therefore, the shutter is prevented from accidentally contacting the article, whereby the article can be prevented from being damaged.

In the forklift according to the thirteenth aspect of the invention, when any one of the above-mentioned various inhibiting operation is conducted, an alarm is given. Therefore, such a failure can be known surely and easily, so that development of unmanned operation is enabled.

The forklift according to the fourteenth aspect of the invention is characterized in that, in any one of the fifth, sixth, eleventh, and twelfth aspects, notification of cancellation of the inhibiting operation is given.

In the forklift according to the fifteenth aspect of the invention, a restraining member for restraining an unnecessary motion of the accommodated article is disposed in the cover. Therefore, an unnecessary motion of the article during transportation can be restrained to prevent the transportation attitude from being broken, so that stable transportation is enabled and the article can be prevented from being damaged.

In the forklift according to the sixteenth aspect of the invention, the restraining member is positioned above the most-lowered position of the fork and on both sides of a lifting region of the fork. An article support face which, in accordance with a lowering operation of the fork, supports the article supported on the fork, from a lower side of the fork is formed. Therefore, an article, which is introduced by the fork can be surely placed and accommodated on the restraining member.

What is claimed is:

1. A forklift comprising:

a travelling carriage;

a straddle arm disposed on the travelling carriage;

a mast disposed on the straddle arm to be reciprocally movable in a horizontal direction;

a fork disposed on the mast to be movable up and down; and a cover disposed on the travelling carriage, wherein when the mast is in a reach-in operation, the cover covers at least an upper side of an article supported by the fork, further comprising a shutter, wherein the cover is fixed to the straddle arm;

wherein the cover is formed into a box-shape to cover the upper, front, rear, right, and left sides of the article, wherein the cover defines an opening portion through which the article is taken in or out; and wherein the shutter closes or opens the opening portion.

2. The forklift according to claim 1, wherein the cover has a height to allow the mast to pass through the cover when the mast is in the reach-in operation.

3. The forklift according to claim 1, wherein the cover has a length in the horizontal direction so that when the mast is in a maximum reach-out state, the fork is positioned outside the cover.

4. The forklift according to claim 3, further comprising a position sensor for detecting a position of the mast in the horizontal direction, wherein when it is detected on the basis of a detection signal from the position sensor that at least one of the mast and the fork is positioned inside the cover, the fork is inhibited from being lifted and lowered outside a predetermined range.

5. The forklift according to claim 4, wherein when the inhibiting operation is conducted, an alarm is given.

6. The forklift according to claim 4, wherein notification of cancellation of the inhibiting operation is given.

7. The forklift according to claim 3, further comprising a position sensor for detecting a lifted position of the fork, wherein when it is detected on the basis of a detection signal from the position sensor that the lifted position of the fork is higher than a predetermined level, the mast is inhibited from performing the reach-in operation.

8. The forklift according to claim 1, wherein the mast has:

an outer mast moving along the straddle arm; and an inner mast lifting and lowering along the outer mast, and wherein the cover has a length in the horizontal direction so that when the mast is in a maximum reach-out state, the inner mast is positioned outside the cover.

9. The forklift according to claim 1, wherein when the shutter opens the opening portion, the shutter is accommodated in the cover.

10. The forklift according to claim 1, wherein a window for interior inspection is defined at a side face of the cover.

11. The forklift according to claim 1, further comprising a door through which an operator enters and exits at a side face of the cover.

12. The forklift according to claim 1, further comprising an article sensor for detecting a height and width of an article on the fork to detect whether or not the article is accommodatable, the article sensor disposed at the opening portion of the cover, wherein when the article sensor detects that the article is not accommodatable, the mast is inhibited from performing the reach-in operation.

13. The forklift according to claim 1, further comprising an end sensor for detecting a rear end of an article to be accommodated in the horizontal direction inside the opening, wherein when the end sensor detects the rear end of the accommodated article, the shutter is inhibited from closing.

14. The forklift according to claim 1, further comprising a restraining member for restraining an unnecessary motion of the accommodated article in the cover.

15. The forklift according to claim 14, wherein the restraining member is positioned above the most-lowered position of the fork and on both sides of a lifting region of the fork; and wherein the restraining member has an article support surface which supports the article supported on the fork from a lower side of the fork, when the fork lowers.

* * * * *